United States Patent [19]

Adelman

[11] Patent Number: 4,981,645

[45] **Date of Patent: * Jan. 1, 1991**

[54] SUPERALLOY COMPOSITIONS

[76] Inventor: Stuart Adelman, 651 Cole St., Apt. 4, San Francisco, Calif. 94117

[ * ] Notice: The portion of the term of this patent subsequent to Aug. 22, 2006 has been disclaimed.

[21] Appl. No.: 347,677

[22] Filed: May 5, 1989

Related U.S. Application Data

[63] Continuation-in-part of Ser. No. 27,555, Mar. 17, 1985, Pat. No. 4,859,416.

[51] Int. Cl.[5] ..... C22C 19/05

[52] U.S. Cl. ..... 420/442; 148/404; 420/6; 420/443; 420/445

[58] Field of Search ..... 420/443, 442, 445, 6; 148/427, 428, 410, 404

[56] References Cited

U.S. PATENT DOCUMENTS 4,859,416 8/1989 Adelman ..... 420/443

*Primary Examiner*—R. Dean

*Attorney, Agent, or Firm*—Watson, Cole, Grindle & Watson

[57] ABSTRACT

The addition of small amounts of rhenium, technitium and their mixtures and, optionally erbium, to a nickel-based superalloy in which the ratio of nickel to chromium is approximately 3–4 to 1, provides enhanced mechanical properties particularly suitable for applications in the manufacture of gas turbine engine components, airframe skins and combustion chambers.

15 Claims, No Drawings

SUPERALLOY COMPOSITIONS

This application is a continuation-in-part of application Ser. No. 027,555, filed Mar. 17, 1985, now U.S. Pat No. 4,859,416.

FIELD OF THE INVENTION

This invention relates generally to the field of eutectic superalloys and, in addition, to their use in gas turbine component manufacture.

BACKGROUND OF THE INVENTION

A nickel-based superalloy known to the art as Nimonic-75 consists of a class of materials which solidify from the molten state according to monovariant eutectic reactions, providing aligned polyphase structures including such systems as the ternary alloys identified as nickel-chromium-carbon and nickel-titanium-chromium-iron. The advantage of alloy compositions of this nature is that the desired microstructure can be achieved over a range of compositions within a given system. This provides a substantial increase in the freedom of selection of compositions, permitting increased optimization of properties.

It has been recognized in the art that directional solidification can enhance the mechanical properties of a particular alloy. Directional solidification involves the formation of a solid phase, e.g., chromium carbide fibers, during the transition from the molten phase. This solidification usually occurs in a particular axial direction. Continued cooling results in additional solidification in the same axial direction as the initial formation. The resulting solidified alloy is immensely strong in that axial direction. See, e.g., U.S. Pat. No. 4,111,723 to Lemkey et al.

The manipulation of alloy compositions to enhance certain properties is known to the art. Slight changes in composition can have a dramatic effect on mechanical strength and toughness. Certainly, the concept of directional solidification is based in part on identifying eutectic compositions wherein the chromium carbide fibers form in the molten phase of the alloy to provide a nucleus for further solidification.

An explanation why the Lemkey et al. composition obtains its attributes is found in a publication, "The Influence of Off-Axis Reinforcement on the Tensile Strength of an Ni-Al-Cr-C Eutectic Composite," Journal of Materials Science 10 (1975), 77–82. As there explained, the presence of aluminum permits the superalloy to form a nickel-aluminum-chromium-carbon eutectic composite, with a nickel-rich matrix containing a dispersion of $Ni_3Al$ precipitate. $Cr_3C_2$ fibers grow with their axes parallel to the crystallographic axis. As understood, the $Cr_3C_2$ fibers and precipitates of $Ni_3Al$ provide the cellular morphology specific to a Lemkey et al. composition. The author, Mr. May, concludes that the superior tensile strength of this composite requires both the presence of aluminum and of chromium carbide fibers.

The present invention provides superalloys having greatly improved mechanical properties. However, my superalloys are not dependent upon directional solidification to provide these enhanced properties, although over the range of compositions present in this invention, there are undoubtedly phases wherein eutectic formation occurs. Directional solidification is not critical to the desired properties, but is intended to fall within the scope of the appended claims, since the present invention achieves its mechanical properties without the presence of aluminum and, therefore, without the directional solidification technique of Lemkey et al.

The present invention comprises an improvement in the mechanical properties of a superalloy through the addition of minor amounts of rhenium and technetium and their mixtures, and optionally, erbium, thorium, uranium or another element of the lanthanide or actinide series. The addition of these materials provides a surprising and unexpected result which can be quantified, in part, by an increase in time to stress rupture at 800° C. of several thousand hours. This unexpected increase permits the use of the improved superalloy in gas turbine engine component manufacture because of its enhanced resistance to failure under stress at high temperatures. Another surprising and unexpected result is that the order of magnitude increase in mechanical properties can be obtained without a corresponding order of magnitude increase in the cost of the improved superalloy.

It is, therefore, an object of this invention to provide an improved superalloy composition with enhanced mechanical properties.

It is another object of this invention to provide an improved superalloy composition at a price comparable to currently available superalloy compositions.

SUMMARY OF THE INVENTION

The present invention provides an improved superalloy composition in which the primary components are nickel and chromium, in a ratio by weight of about 3–4 to 1. To this basic composition are added up to 1% erbium, preferably 0.2–0.7% erbium, and further additions consisting of 0.1 to 10 atomic percent of an element selected from the group consisting of technetium, rhenium and mixtures thereof. In a particularly preferred embodiment, the additions specifically consist of about 2–10 atomic percent rhenium and 10–1000 parts per million technetium. In my invention, however, aluminum is not present in an amount sufficient to form a substantial quantity of Ni-Al-Cr-C eutectic composite.

DETAILED DESCRIPTION OF THE INVENTION

The present invention relates to improved superalloy compositions, specifically nickel-based superalloys used in high temperature applications where high mechanical stresses must be endured. The present invention constitutes an improvement over the composition known to the art as Nimonic-75. The present invention combines the basic composition of Nimonic-75 with additions of technetium, rhenium and their mixtures, preferably with the addition of an active element such as erbium, and thereby produces a composition which exhibits significantly enhanced utility in gas turbine engine component manufacture.

In addition to the improvements seen in Nimonic-75, it is predicted that similar surprising increases will occur in the Nimonic-80A and Nimonic-C263 upon the addition of erbium, rhenium and technetium. According to the McGraw-Hill Encyclopedia of Science and Technology, Volume 9, page 112, c 1977, Nimonic-75 is a nickel-based alloy containing 19.5% chromium, 0.4% titanium, 0.12% carbon and maxima of 0.5% copper, 5% iron, 1% manganese and 1% silicon Nimonic-80A is the same formula, except that it has 1.1% aluminum, 2.2% titanium, and a maximum of 2% cobalt and 0.1% carbon. Nimonic-80A contains no copper. Nimonic-C263 has a similar formulation, namely, 0.5% aluminum with 2% titanium, 6% molybdenum, 20% cobalt and 20% chromium. The balance of each composition is essentially nickel. Thus, in each composition the ratio of Ni to Cr is about 3–4 to 1.

Expressed otherwise, the basic composition of this invention is 2–3 weight percent iron, 19.3–19.7% chromium, about 0.5% carbon, the balance essentially nickel. To this composition is added up to 1 weight percent of an element selected from the lanthanide or actinide series, e.g., erbium, thorium, uranium, or plutonium (preferably 0.2–0.7 weight percent), from about 0.1 to about 10 atomic percent of an element selected from the group consisting of technetium, rhenium and their mixtures. In the case of rhenium alone, the amount required will be from 2 to 10 atomic percent, preferably 5–9 atomic percent, and in the case of technetium alone, the amount will be from about 10 to 1000 parts per million, preferably about 0.02 to 0.1 weight percent.

In the case of technetium alone, it must be noted that technetium is not a naturally occurring element. Therefore, each atom of technetium must be made rather than mined. The inclusion of large amounts of technetium is therefore practically precluded because with the current technetium production facilities the desirable improved mechanical properties can only now be obtained at prohibitive cost.

With regard to the amount of aluminum present in the superalloy, it is preferred that no aluminum be present. However in the case of Nimonic-80A, which contains 1.1% Al, that amount should not be substantially exceeded, since the Al is not an important part of the composition of my invention. Preferably, the Al present is less than about 0.5% by weight.

The enhanced mechanical suitability of an alloy having the composition described above is more clearly understood with reference to Table 1. In Table 1, the stress rupture time of a sample of the alloy is shown to increase from 55 hours at 800° C. to 4300 hours at 800° C. upon the addition of rhenium and technetium. The improvement shown upon the addition of minor amounts of rhenium and technetium is evident from the last two entries in Table 1. In particular, the stress rupture time increases nearly ten fold by the addition of approximately 480 parts per million of technetium. This result could not be anticipated from the previous art and the resulting dramatic increase in mechanical suitability provides a surprising and unexpected result.

TABLE 1

| | wt % Re | wt % Re + wt % Tc | |
|---|---|---|---|
| Stress Rupture Time at 25 kg/mm² in Hours @ 800° C. | | | |
| 55 | 0 | 0 | |
| 55 | 1.5 | 0.5 | 5 ppm |
| 160 | 2 | 1 | 5 ppm |
| 260 | 2.5 | 2 | 5 ppm |
| 320 | 4 | | |
| 410 | 6 | 2 | 10 ppm |
| 500 | 8 | 4 | 20 ppm |
| 590 | 10 | 6 | 20 ppm |
| 460 | | 6 | 500 ppm |
| Stress Rupture Time | | | |
| @ 14 kg/mm² and 900° C. = 300 hours | 9.5 | | |
| @ 16 kg/mm² and 1000° C. = 300 hours | 9.5 | | |

Materials of this composition can be cast according to the well known techniques described in U.S. Pat. Nos. 3,124,542; 3,260,505; and 3,495,709. These materials can be wrought or fabricated by powder techniques such as hot isostatic pressing. Similarly, rapid-solidification-rate (RSR) technology can be applied to these materials so as to obtain the benefits of aligned crystal growth in the same manner as directional casting. The mechanical properties of the subject improved superalloy make it particularly well suited to the extremely high-stress environment of gas turbine engines, more specifically, as a material from which the turbine blade is constructed. The subject superalloy is also highly suited for use as sheet in the construction of the skin of the airframe in aerospace vehicles and as the skin of combustion chambers of gas turbine, ramjet and rocket engines.

While the subject invention has been described with respect to a particularly preferred embodiment, it will be apparent to those skilled in the art that certain modifications may be made, all of which are intended to be included within the scope of the following, appended claims.

I claim:

1. A superalloy composition comprising nickel and chromium in a ratio of about 3–4 to 1 by weight, said composition being free of an amount of aluminum sufficient to form a substantial quantity of Ni-Al-Cr-C eutectic composite, said composition also comprising 0 to 1% of an element of the lanthanide or actinide series of the periodic table, and 0.1 to 10 atomic percent of an additive element selected from the group consisting of rhenium, technetium and mixtures thereof, said superalloy composition having improved mechanical properties independent of directional solidification thereof.

2. A superalloy composition as claimed in claim 1, in which the amount of aluminum present is not greater than about 1.1% by weight.

3. A superalloy composition as claimed in claim 1, in which the amount of aluminum present is less than about 0.5% by weight.

4. A superalloy composition as claimed in claim 1, in which said additive element is rhenium.

5. A superalloy composition as claimed in claim 4, in which said rhenium is present in about 2 to 10 atomic percent.

6. A superalloy composition as claimed in claim 4, in which said rhenium is present in about 5 to 9 atomic percent.

7. A superalloy composition as claimed in claim 1, in which said element is selected from the group consisting of erbium, thorium, uranium and plutonium.

8. A superalloy composition as claimed in claim 7, in which said element is erbium.

9. A superalloy composition as claimed in claim 8, in which said erbium is present in about, 0.2 to 0.7% by weight.

10. A superalloy composition as claimed in claim 1, in which said additive element is technetium.

11. A superalloy composition as claimed in claim 10, in which said technetium is present in about 0.02 to 0.1% by weight.

12. A superalloy composition as claimed in claim 1, in which said additive element is a mixture of about 2 to 10 atomic percent rhenium and about 10 to 1000 ppm technetium.

13. A gas turbine engine component made from a superalloy composition as claimed in claim 1.

14. An airframe skin made from a superalloy composition as claimed in claim 1.

15. A combustion chamber made from a superalloy composition as claimed in claim 1.

* * * * *